US005775812A

United States Patent [19]

St. Phillips et al.

[11] Patent Number: 5,775,812

[45] Date of Patent: Jul. 7, 1998

[54] TAMPER-EVIDENT RECLOSABLE PLASTIC BAG WITH BREAKAWAY SLIDER

[75] Inventors: Eric A. St. Phillips, Fairport; David G. Vanderlee, Macedon, both of N.Y.

[73] Assignee: Tenneco Packaging, Evanston, Ill.

[21] Appl. No.: 754,022

[22] Filed: Nov. 20, 1996

[51] Int. Cl.[6] ..... B65D 33/18

[52] U.S. Cl. ..... 383/5; 383/64

[58] Field of Search ..... 383/5, 63, 64, 383/69, 97

[56] References Cited

U.S. PATENT DOCUMENTS

| | | | |
|---|---|---|---|
| Re. 33,674 | 8/1991 | Uramoto | 206/620 |
| Re. 34,554 | 3/1994 | Ausnit | 383/63 |
| 3,780,781 | 12/1973 | Uramoto | 150/3 |
| 3,818,963 | 6/1974 | Whitman . | |
| 4,112,990 | 9/1978 | Anderson | 383/97 |
| 4,153,090 | 5/1979 | Rifkin . | |
| 4,196,030 | 4/1980 | Ausnit | 156/91 |
| 4,602,405 | 7/1986 | Sturman et al. | 383/5 X |
| 4,895,198 | 1/1990 | Samuelson . | |
| 4,902,140 | 2/1990 | Branson | 383/63 X |
| 4,923,309 | 5/1990 | VanErden | 383/5 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,023,122 | 6/1991 | Boeckmann et al. | 428/43 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,088,971 | 2/1992 | Herrington | 493/203 |
| 5,092,684 | 3/1992 | Weeks | 383/61 |
| 5,092,831 | 3/1992 | James et al. | 493/394 |
| 5,116,301 | 5/1992 | Robinson et al. | 493/215 |
| 5,121,997 | 6/1992 | LaPierre et al. | 383/203 |
| 5,129,734 | 7/1992 | Van Erden | 383/61 |
| 5,131,121 | 7/1992 | Herrington, Jr. et al. | 24/436 |
| 5,152,613 | 10/1992 | Herrington, Jr. . | |
| 5,161,286 | 11/1992 | Herrington, Jr. et al. | 24/387 |
| 5,186,543 | 2/1993 | Cochran | 383/203 |
| 5,189,764 | 3/1993 | Herrington et al. | 24/387 |
| 5,211,482 | 5/1993 | Tilman | 383/202 |
| 5,224,779 | 7/1993 | Thompson et al. | 383/5 |
| 5,283,932 | 2/1994 | Richardson et al. | 24/400 |
| 5,301,394 | 4/1994 | Richardson et al. | 24/399 |

(List continued on next page.)

FOREIGN PATENT DOCUMENTS

| | | | |
|---|---|---|---|
| 0 109 793 | 5/1984 | European Pat. Off. . | |
| 0 374 539 | 6/1990 | European Pat. Off. . | |
| 1350126 | 12/1963 | France | 383/97 |
| 2268721 | 1/1994 | United Kingdom | 383/97 |
| 2268731 | 1/1994 | United Kingdom | 383/97 |
| WO95/29604 | 11/1995 | WIPO . | |
| WO95/35046 | 12/1995 | WIPO . | |
| WO95/35047 | 12/1995 | WIPO . | |
| WO95/35048 | 12/1995 | WIPO . | |

*Primary Examiner*—Jes F. Pascula
*Attorney, Agent, or Firm*—Arnold, White & Durkee

[57] ABSTRACT

A tamper-evident reclosable plastic bag comprises first and second opposing panels, a zipper, a slider, and an end termination. The first and second opposing panels are fixedly connected to each other along a pair of sides and a bottom bridging the pair of sides. The zipper extends along a mouth formed opposite the bottom. The zipper includes a first track with a first profile and a second track with a second profile. The first and second profiles are releasably engageable to each other. The slider is slidably mounted to the zipper for movement between a closed position and an open position. The first and second profiles are engaged to each other while the slider is in the closed position. The first and second profiles are disengaged from each other in response to movement of the slider from the closed position to the open position. The end termination is near one end of the zipper adjacent to one of the pair of sides. To minimize tampering with the plastic bag, a one-time breakable element initially connects the slider to the end termination. The breakable element is intact while the slider is initially in the closed position, and the element is broken in response to movement of the slider from the closed position to the open position.

8 Claims, 2 Drawing Sheets

U.S. PATENT DOCUMENTS

| | | | |
|---|---|---|---|
| 5,301,395 | 4/1994 | Richardson et al. | 24/400 |
| 5,405,478 | 4/1995 | Richardson et al. | 156/308.4 |
| 5,426,830 | 6/1995 | Richardson et al. | 24/430 |
| 5,431,760 | 7/1995 | Donovan | 156/66 |
| 5,435,864 | 7/1995 | Machacek et al. | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,448,808 | 9/1995 | Gross . | |
| 5,456,928 | 10/1995 | Hustad et al. | 426/87 |
| 5,482,375 | 1/1996 | Richardson et al. | 383/64 |
| 5,669,715 | 9/1997 | Dobreski et al. | 383/203 X |
| 5,682,730 | 11/1997 | Dobreski . | |

TAMPER-EVIDENT RECLOSABLE PLASTIC BAG WITH BREAKAWAY SLIDER

FIELD OF THE INVENTION

The present invention generally relates to reclosable plastic bags and, more particularly, relates to a tamper-evident reclosable plastic bag having a tamper-evident element for initially securing a zipper slider in a closed position and for providing tamper evidence in response to movement of the slider from the initial closed position to an open position.

BACKGROUND OF THE INVENTION

A reclosable plastic bag typically includes first and second opposing panels fixedly connected to each other along a pair of sides and a bottom bridging the pair of sides. The first and second panels are not fixedly connected along a mouth which is formed opposite to the sealed bottom. Rather, the bag is provided with a reclosable zipper extending along the mouth of the plastic bag. The zipper includes a male track and a female track. In reclosable plastic bags of the type disclosed in U.S. Pat. No. 5,067,208 utilizing a slider to open the zipper, the male track typically includes a male profile and a first fin extending downward from the male profile. Likewise, the female track in such bags with sliders includes a female profile and a second fin extending downward from the female profile. The first and second fms are thermally fused to the inner surfaces of the respective first and second panels.

The male and female tracks are typically free of any plastic material above the male and female profiles in order to permit proper mounting and movement of the slider. The male and female profiles are releasably engageable to each other. When the slider is in a closed position, the male and female profiles are interlocked with each other. In response to moving the slider to an open position, the male and female profiles are disengaged from each other. Once the male and female profiles are disengaged from each other, access to the interior of the bag may be obtained by pulling the first and second panels apart at the mouth. Prior to moving the slider to the open position, it is difficult to gain access to the interior of the bag because the engaged profiles are difficult to grasp and pull apart by hand without the use of the slider. The engaged profiles are difficult to grasp because the tracks do not include graspable upper flanges.

Opposite ends of the zipper are provided with end terminations. The end terminations perform the dual finction of stops for the ends of the zipper to prevent the slider from going past the ends of the zipper and, in addition, they hold the male and female profiles together to resist stresses applied to the profiles during normal use of the plastic bag. In U.S. Pat. No. 5,067,208, each end termination is in the form of a strap/clip that wraps over the top of the zipper. One end of the strap is provided with a rivet-like member that penetrates through the zipper fins and into a cooperating opening at the other end of the strap. Other types of end terminations are disclosed in U.S. Pat. Nos. 5,482,375, 5,448,807, 5,442,837, 5,405,478, 5,161,286, 5,131,121, and 5,088,971.

Reclosable plastic bags of the foregoing type are a great convenience to the consumer especially for products such as deli meats and cheeses where, typically, only a portion of the product is used at any given time. A problem with these reclosable bags, however, is that if such plastic bags are to be prepackaged with a food product and then sold in a grocery store, the contents of the plastic bags can easily be tampered with prior to purchase by the consumer.

A need therefore exists for a tamper-evident reclosable plastic bag with slider.

SUMMARY OF THE INVENTION

The plastic bag comprises first and second opposing panels fixedly connected to each other along a pair of sides and a bottom bridging the pair of sides. The bag is provided with a reclosable zipper extending along a mouth formed opposite the sealed bottom of the plastic bag. The zipper includes a male track and a female track. The male track includes a male profile and a first depending fin extending downward from the male profile. Likewise, the female track includes a female profile and a second depending fin extending downward from the female profile. If the zipper is formed separately from the panels of the bag, the first and second depending fins are thermally fused to inner surfaces of the respective first and second panels. Alternatively, the zipper may be integrally formed with the panels of the bag.

A slider is slidably mounted to the zipper for movement between a closed position and an open position. The male and female profiles are engaged to each other while the slider is in the closed position. The male and female profiles are disengaged from each other in response to movement of the slider to the open position.

To prevent the slider from going past opposite ends of the zipper and to provide adequate end strength that resists stresses applied to the profiles during normal use of the bag, end terminations are located on the male and female tracks adjacent to the opposite ends of the zipper. The end terminations are preferably in the form of clips mounted to the zipper.

To minimize tampering with the contents of the plastic bag prior to being initially opened, the slider is initially parked in the closed position at one end of the zipper, and the slider is detachably connected to a nearest one of the end terminations by a one-time breakable gate. The slider cannot be moved from the closed position until the gate has been broken. Thus, an intact gate indicates that the plastic bag likely has not been tampered with, while a broken gate indicates that the slider has previously been moved from the closed position.

BRIEF DESCRIPTION OF THE DRAWINGS

Other objects and advantages of the invention will become apparent upon reading the following detailed description and upon reference to the drawings in which.

Figure 1:
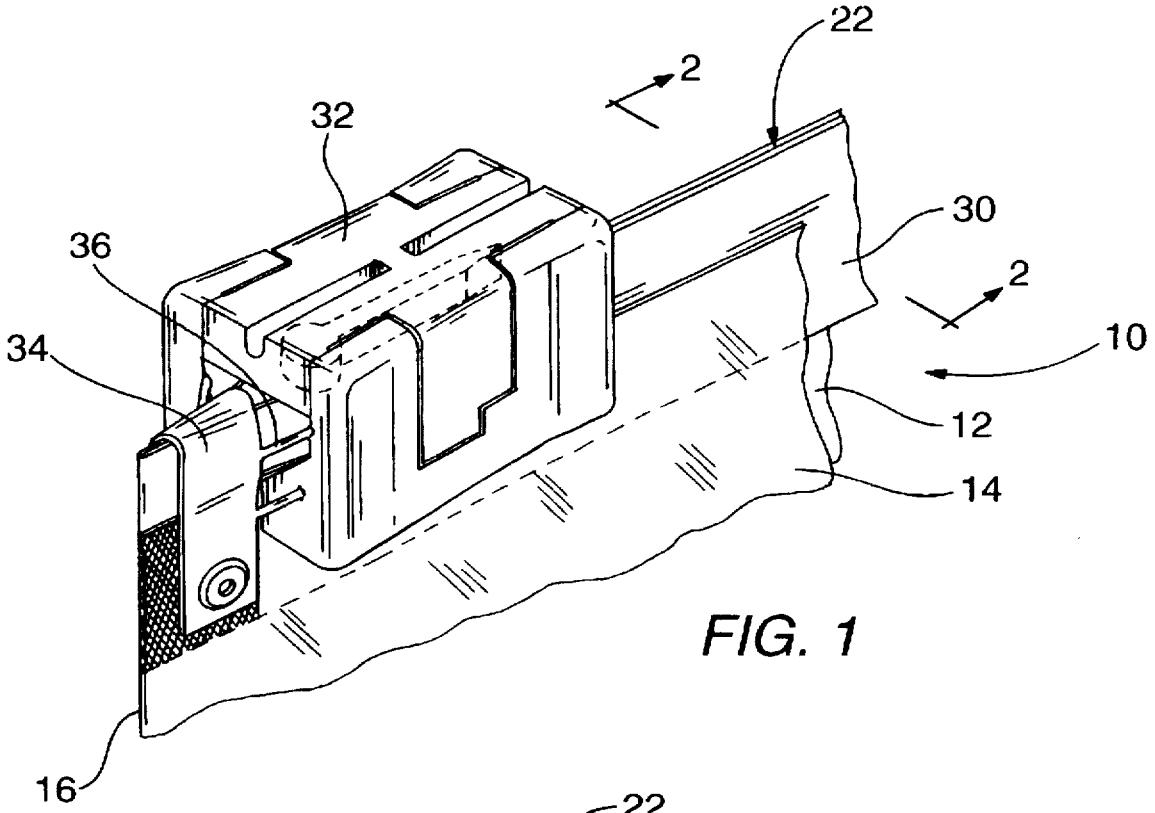
FIG. 1 is an isometric view of a mouth portion of a reclosable plastic bag prior to breaking a one-time breakable gate connecting a slider to an end clamp.
Figure 2:
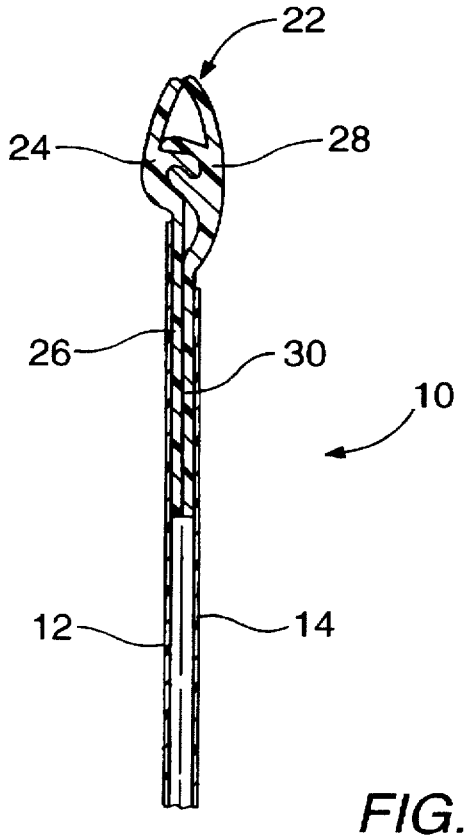
FIG. 2 is a sectional view taken generally along line 2—2 in FIG. 1.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIGS. 1–4 depict a mouth portion 10 of a reclosable plastic bag embodying the present invention. The plastic bag comprises first and second opposing panels 12 and 14 fixedly connected to each other along a pair of sides 16 (only one shown in FIGS. 1–4) and a bottom bridging the pair of sides 16. The bag is provided with a reclosable zipper 22 extending along the mouth portion 10, which is formed opposite the sealed bottom of the plastic bag.

The zipper 22 includes a male track and a female track. The male track includes a male profile 24 and a first depending fin or flange 26 extending downward from the male profile 24. Likewise, the female track includes a female profile 28 and a second depending fin or flange 30 extending downward from the female profile 28. The first and second fins 26 and 30 are thermally fused to inner surfaces of the respective first and second panels 12 and 14. Alternatively, the zipper 22 may be extruded with the panels 12 and 14 such that the first fin 26 is integrally formed with the first panel 12 and the second fin 30 is integrally formed with the second panel 14.

To assist in opening the plastic bag, a slider 32 is slidably mounted to the zipper 22 for movement between a closed position and an open position. In the closed position of the slider 32 shown in FIGS. 1 and 3, the male and female profiles 24 and 28 are interlocked with each other. Movement of the slider 32 from the closed position in FIGS. 1 and 3 toward the open position (see FIG. 4) disengages the male and female profiles 24 and 28 from each other and allows a user to gain access to the interior of the plastic bag.

Figure 3:
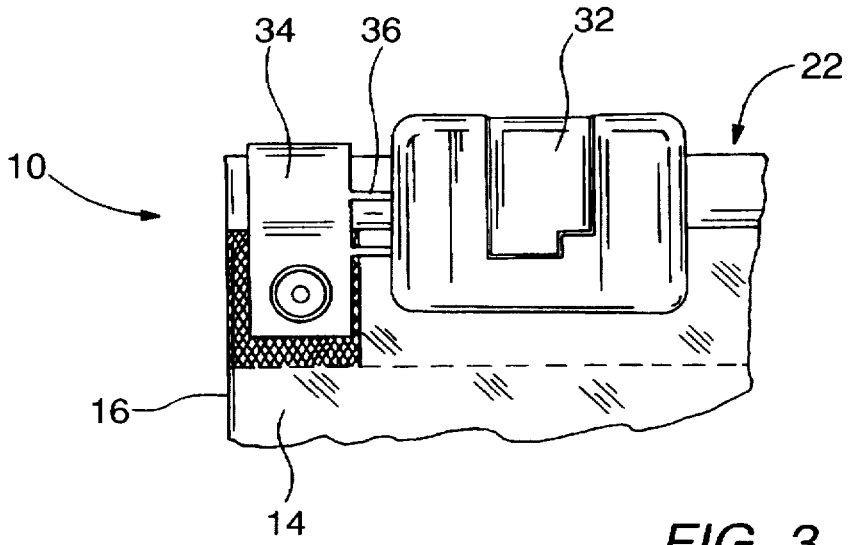
FIG. 3 is a front view of the bag mouth portion in FIG. 1.
Figure 4:
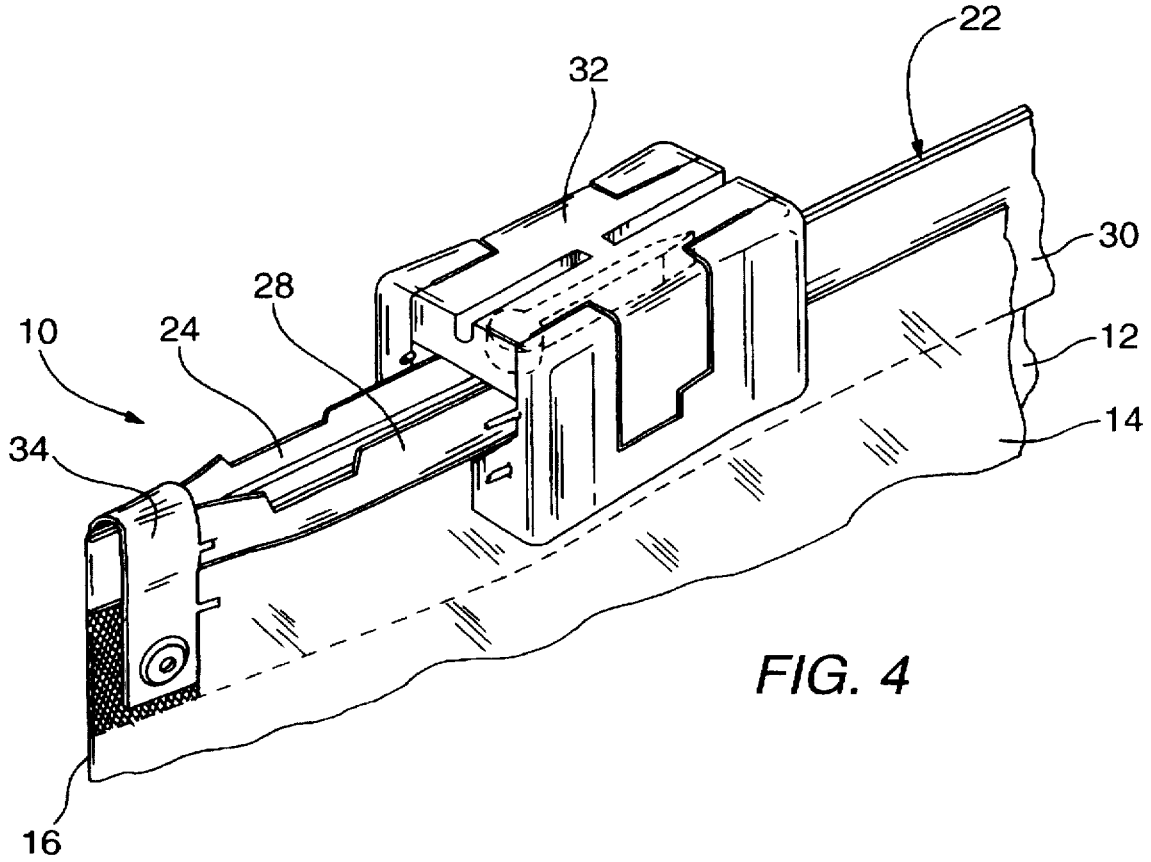
FIG. 4 is an isometric view of the bag mouth portion after the one-time breakable gate has been broken.

Opposite ends of the zipper 22 are provided with end termination clamps 34 (only one shown in FIGS. 1, 3, and 4). Each end clamp 34 includes a strap member that wraps over the top of the zipper 22. To mount the strap to the zipper 22, one end of the strap is provided with a rivet-like member that is adapted to penetrate through the bag material and into a cooperating opening at the other end of the strap. The end clamps 34 perform the dual function of stops for the ends of the zipper 22 to prevent the slider 32 from going past the end of the zipper 22 and, in addition, they hold the male and female profiles 24 and 28 together to resist stresses applied to the profiles during normal use of the plastic bag. Further details concerning the construction and operation of the slider 32 and the end clamps 34 may be obtained from U.S. Pat. No. 5,067,208 to Herrington, Jr. et al., which is incorporated herein in its entirety by reference. The end clamps 34 are merely illustrative and may take other forms known in the art.

To minimize tampering with the contents of the plastic bag prior to being initially opened, the slider 32 is initially parked in the closed position at one end of the zipper 22 as depicted in FIGS. 1 and 3. Also, the slider 32 is detachably connected to a nearest one of the end clamps 34 by a one-time breakable gate or bridge 36. The gate 36 has one or more elongated members extending between the end clamp 34 and the slider 32. In the illustrated embodiment, there are a pair of elongated members on each side of the zipper 22. The slider 32 cannot be moved from the closed position until the gate 36 has been broken. The force of moving the slider 32 from the closed position toward the open position ruptures the gate 36 as shown in FIG. 4, thereby allowing the slider 32 to be moved to the open position. The amount of force required to rupture the gate 36 is preferably high enough that the gate 36 will not accidentally break during shipping and handling, but is small enough that a consumer will not need to apply undue force to the slider 32.

Thus, an intact gate 36 indicates that the plastic bag likely has not been tampered with because, as stated previously, the engaged profiles 24 and 28 are difficult to grasp and pull apart without the use of the slider 32. A broken gate 36, on the other hand, indicates that the slider has previously been moved away from the closed position, and the contents of the plastic bag may have been tampered with.

While the present invention has been described with reference to one or more particular embodiments, those skilled in the art will recognize that many changes may be made thereto without departing from the spirit and scope of the present invention. For example, the gate 36 may be substituted with any breakable element initially securing the slider 32 in the closed position and being broken and therefore providing tamper evidence in response to movement of the slider 32 from the initial closed position to the open position. The breakable element may connect the slider 32 to the end clamp 34 or, alternatively, may connect the slider 32 to the zipper 22. With regard to the latter, the breakable element may take the form of adhesive, shrink wrap, a post, or any other means that initially secures the slider 32 in the closed position and provides tamper evidence in response to movement of the slider 32 from the initial closed position to the open position. Each of these embodiments and obvious variations thereof is contemplated as falling within the spirit and scope of the claimed invention, which is set forth in the following claims.

What is claimed is:

1. A taper-evident reclosable plastics bag, comprising:

first and second opposing panels fixedly connected to each other along a pair of sides and a bottom bridging said pair of sides:

a reclosable zipper extending along a mouth formed opposite said bottom, said zipper including a first track with a first profile and a second track with a section profile, said first and second profiles being releasably engageable to each other; and a slider slidably mounted to said zipper for movement between a closed position and an open position, said first and second profiles being engaged to each other while said slider is in said closed position, said first and second profiles being disengaged from each other in response to movement of said slider from said closed position to said open position;

an end termination near one end of said zipper adjacent to one of said pair of sides; and a one-time breakable, irreplaceable element initially integrally connecting said slider to said end termination to secure said slider in said closed position and being broken in response in response to movement of said slider from said closed position to said open position.

2. The plastic bag of claim 1, wherein said breakable element includes a gate having one or more elongated members bridging said end termination and said slider.

3. The plastic bag of claim 1, wherein said first and second tracks are substantially free of graspable upper flanges extending upwardly from said respective first and second profiles.

4. The plastic bag of claim 1, wherein said end termination includes a clamp mounted to said zipper.

5. A tamper-evident reclosable plastic bag, comprising:

first and second opposing panels fixedly connected to each other along a pair of sides and a bottom bridging said pair of side;

a reclosable zipper extending along a mouth formed opposite said bottom, said sipper including a first track with, a first profile and a second track with a second profile, said first and second profiles being releasably engageable to each other;

a slider slidably mounted to said zipper for movement between a closed position and an open position said first and second profiles being engaged to each other while said slider is in said closed position said first and second profiles being disengaged from, each other in response to movement of said slider from said closed position to said open position;

an end termination near one end of laid zipper adjacent to one of said pair of sides; and tamper-evident means, coupled to said slider, for initially securing said slider in said closed position and for providing tamper evidence in response to movement of said slider from said closed position to said open position, said tamper-evident means including a one time breakables irreplaceable element initially integally connecting said slider to said end termination and being broken in response to movement of said slider from said closed position to said open position.

6. In a reclosable plastic bag including first and second opposing panels fixedly connected to each other along a pair of sides and a bottom bridging said pair of sides, a reclosable zipper extending along a mouth formed opposite said bottom, said zipper including a fist track with first profile and a second track with a second profile, said first and second profiles being releasably engageable to each other; a slider slidably mounted to said zipper for movement between a closed position and an open position, said first and second profiles being engaged to each other while said slider is in said closed position, said first and second profiles being disengaged from each other in response to movement of said slider from said closed position to said open position; and an end termination near one end of said zipper adjacent to one of said pair of sides, a tamper-evident feature comprising:

a one-time breakable irreplaceable element initially integrally connecting said slider to said end termination to secure said slider in said closed position and being broken in response to movement of said slider from said closed position to said open position.

7. The tamper-evident feature of claim 6, wherein said plastic bag includes an end termination near one end of said zipper adjacent to one of said pair of sides, and wherein said breakable element initially connects said slider to said end termination, said breakable element being intact while said slider is initially in said closed position, said breakable element being broken in response to movement of said slider from said closed position to said open position.

8. The tamper-evident feature of claim 7, wherein said breakable element includes a gate having one or more elongated members bridging said end termination and said slider.

* * * * *